US006905402B2

(12) United States Patent
Allison et al.

(10) Patent No.: US 6,905,402 B2
(45) Date of Patent: Jun. 14, 2005

(54) POLISHING PAD FOR PLANARIZATION

(75) Inventors: William C. Allison, Murrysville, PA (US); Robert G. Swisher, Pittsburgh, PA (US); Alan E. Wang, Gibsonia, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 10/664,860

(22) Filed: Sep. 22, 2003

(65) Prior Publication Data

US 2004/0102137 A1 May 27, 2004

Related U.S. Application Data

(60) Provisional application No. 60/413,366, filed on Sep. 25, 2002.

(51) Int. Cl.[7] ..... B24D 11/00

(52) U.S. Cl. ..... 451/533; 451/526; 451/451; 451/28

(58) Field of Search ..... 451/526, 527, 451/528, 530, 533, 537, 28, 534

(56) References Cited

U.S. PATENT DOCUMENTS 5,212,910 A * 5/1993 Breivogel et al. ..... 451/530
6,306,021 B1 * 10/2001 Masumura et al. ..... 451/287
6,354,915 B1 * 3/2002 James et al. ..... 451/41
6,402,591 B1 6/2002 Thornton
6,477,926 B1 * 11/2002 Swisher et al. ..... 451/526
6,623,337 B2 * 9/2003 Scott et al. ..... 451/41
6,656,018 B1 * 12/2003 Hsu et al. ..... 451/41
2003/0094593 A1 5/2003 Hellring et al.
2003/0217517 A1 11/2003 Allison et al.

FOREIGN PATENT DOCUMENTS

EP 0 845 328 A2 6/1998
WO WO 96/15887 5/1996
WO WO 02/22309 A1 3/2002

OTHER PUBLICATIONS

ASTM D 1622–88 "Standard Test Method for Apparent Density of Rigid Cellular Plastics".
ASTM D 2240–91 "Standard Test Method for Rubber Property–Durometer Hardness".
ASTM D 4284–88 "Standard Test Method for Determining Pore Volume Distribution of Catalysts by Mercury Intrusion Porosimetry".
U.S. Appl. No. 09/882,548, filed Jun. 14, 2001 "A Silica-Based Slurry", 6,656,241.

* cited by examiner

*Primary Examiner*—Dung Van Nguyen
(74) *Attorney, Agent, or Firm*—Carol A. Marmo

(57) ABSTRACT

The present invention relates to a polishing pad. In particular, the polishing pad of the present invention comprises a sublayer, a middle layer, and a top layer which can function as a polishing layer. The polishing pad of the present invention is useful for polishing articles and particularly useful for chemical mechanical polishing or planarization of a microelectronic device, such as a semiconductor wafer.

69 Claims, No Drawings

POLISHING PAD FOR PLANARIZATION

This application claims benefit of application Ser. No. 60/413,366 filed Sep. 25, 2002.

The present invention relates to a polishing pad. In particular the polishing pad of the present invention comprises a sublayer, a middle layer, and a top layer which can function as a polishing layer. The polishing pad of the present invention is useful for polishing articles and particularly useful for chemical mechanical polishing or planarization of a microelectronic device, such as a semiconductor wafer.

In general, the polishing or planarization of a non-planar surface of a microelectronic device to an essentially planar surface can involve rubbing the non-planar surface with the work surface of a polishing pad using a controlled and repetitive motion. A polishing slurry can be interposed between the rough surface of the article that is to be polished and the work surface of the polishing pad.

The fabrication of a microelectronic device such as a semiconductor wafer generally involves the formation of a plurality of integrated circuits on the wafer comprising, for example, silicon or gallium arsenide. The integrated circuits can be formed by a series of process steps in which patterned layers of materials such as conductive, insulating and semiconducting materials are formed on the substrate. In order to maximize the density of integrated circuits per wafer, it is desirable to have an essentially planar polished substrate at various stages throughout the semiconductor wafer production process. Thus, semiconductor wafer production generally includes at least one, and can include a plurality of polishing steps, which can use one or more polishing pads.

In a chemical mechanical polishing (CMP) process, the microelectronic substrate can be placed in contact with a polishing pad. The pad can be rotated while a force is applied to the backside of the microelectronic device. An abrasive-containing chemically-reactive solution or slurry can be applied to the pad during polishing. CMP polishing slurries can contain an abrasive material, such as silica, alumina, ceria or mixtures thereof. The polishing process is facilitated by the rotational movement of the pad relative to the substrate as slurry is provided to the device/pad interface. Polishing is continued in this manner until the desired film thickness is removed.

Depending on the selection of polishing pad and abrasive, and other additives, the CMP process can provide effective polishing at desired polishing rates while minimizing surface imperfections, defects, corrosion, and erosion.

Polishing or planarization characteristics are often variable from pad-to-pad and throughout the operating lifetime of a given pad. Variations in the polishing characteristics of the pads can result in inadequately polished or planarized substrates which are not useful. Thus, it is desirable in the art to develop a polishing pad that exhibits reduced pad-to-pad variation in polishing or planarization characteristics. It is further desirable to develop a polishing pad that exhibits reduced variations in polishing or planarization characteristics throughout the operating lifetime of the pad. The present invention includes a polishing pad comprising a sublayer; a middle layer; and a top layer, wherein said top layer can absorb at least two (2) percent by weight of polishing slurry based on the total weight of the top layer.

The polishing pad of the present invention can include a sublayer, a middle layer, and a top layer. In a non-limiting embodiment, the present invention can include a stacked pad assembly wherein at least a portion of the sublayer can be connected to at least a portion of the middle layer, and at least a portion of the middle layer can be connected to at least a portion of the top layer. The sublayer can function as the bottom layer of the pad which can be attached to the platen of the polishing apparatus. In a non-limiting embodiment, the middle layer can be substantially nonporous and substantially impermeable to polishing slurry. The top layer can function as the polishing or working surface of the pad such that the top layer can at least partially interact with the substrate to be polished and the polishing slurry. In a non-limiting embodiment, the top layer can be porous and permeable to polishing slurry.

As used herein and the claims, the term "connected to" means to link together or place in relationship either directly, or indirectly by one or more intervening materials. As used herein and the claims the term "substantially nonporous" means generally impervious to the passage of liquid, gas, and bacteria. On a macroscopic scale, a substantially nonporous material exhibits few if any pores. As used herein and the claims, the term "porous" means having pore(s) and the term "pore(s)" refers to minute opening(s) through which matter passes.

It is noted that, as used in this specification, the singular forms "a," "an," and "the" include plural referents unless expressly and unequivocally limited to one referent.

For the purposes of this specification, unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements.

In a non-limiting embodiment of the present invention, the sublayer can increase the uniformity of contact between the polishing pad and the surface of the substrate being polished. A consideration in selecting the material for the sublayer can be the capability of a material to provide compliant support to the work surface of the polishing pad such that the top layer substantially conforms to the macroscopic contour or long-term surface of the device being polished. A material having said capability can be desirable for use as the sublayer in the present invention.

The surface of a microelectronic substrate, such as a semiconductor wafer, can have a "wave" contour as a result of the manufacturing process. It is contemplated that if the polishing pad cannot adequately conform to the "wave" contour of the substrate surface, the uniformity of the polishing performance can be degraded. For example, if the pad substantially conforms the ends of the "wave", but cannot substantially conform and contact the middle portion of the "wave", only the ends of the "wave" can be polished or planarized and the middle portion can remain substantially unpolished or unplanarized.

In a non-limiting embodiment, the sublayer can be softer than the top layer. As used herein, the term "softness" refers to the Shore A Hardness of the material. In general, the softer the material, the lower the Shore A Hardness value. Thus, in the present invention the Shore A Hardness value of the sublayer can be lower than the Shore A Hardness value of the top layer. In alternate non-limiting embodiments, the sublayer can have a Shore A Hardness of at least 15, or at least 45, or 75 or less, or from 45 to 75. In further alternate non-limiting embodiments, the Shore A Hardness of the top layer can be at least 85, or 99 or less, or from 85 to 99. The Shore A Hardness value can be determined using various methods and equipment known in the art. In a non-limiting embodiment, Shore A Hardness can be determined in accordance with the procedure recited in ASTM D 2240, using a Shore "Type A" Durometer having a maximum indicator (available from PCT Instruments, Los Angeles, Calif.). In a non-limiting embodiment, the test method for Shore A Hardness can include the penetration of a specific type of indentor being forced into the test material under specified conditions. In this embodiment, the Hardness can be inversely related to the penetration depth and can be dependent on the elastic modulus and viscoelastic behavior of the test material.

In another non-limiting embodiment of the present invention, the sublayer of the polishing pad can have a compressibility greater than the top layer. In another non-limiting embodiment, the sublayer can have a compressibility greater than the middle layer. As used herein, the term "compressibility" refers to the percent volume compressibility measurement. In a non-limiting embodiment, the percent volume compressibility of the sublayer can be greater than the percent volume compressibility of the top layer. In alternate non-limiting embodiments, the percent volume compressibility of the sublayer can be less than 20 percent when a load of 20 psi is applied, or less than 10 percent when a load of 20 psi is applied, or less than 5 percent when a load of 20 psi is applied. In another non-limiting embodiment, the percent volume compressibility of the top layer can be less than the percent volume compressibility of the sublayer. In a further non-limiting embodiment, the percent volume compressibility of the top layer can be at least 0.3 percent, or 3 percent or less, or from 0.3 to 3 percent, when a load of 20 psi is applied.

The percent volume compressibility of a pad layer can be determined using various methods known in the art. In a non-limiting embodiment, the percent volume compressibility of a pad layer can be determined using the following expression.

$$100 \times \frac{(\text{pad layer volume without load} - \text{pad layer volume under load})}{(\text{pad layer volume without load})}$$

In a non-limiting embodiment, the area of the pad layer does not change when the load is placed on it; thus, the preceding equation for volume compressibility can be expressed in terms of pad layer thickness by the following expression.

$$100 \times \frac{(\text{pad layer thickness without load} - \text{pad layer thickness under load})}{(\text{pad layer thickness without load})}$$

The pad layer thickness can be determined using a variety of known methods. In a non-limiting embodiment, the pad layer thickness can be determined by placing a load (such as, but not limited to, calibrated weights) on the pad sample and measuring the change in thickness of the pad layer as a result of the load. In a further non-limiting embodiment, a Mitutoyo Electronic Indicator, Model ID-C112EB can be used. The indicator has a spindle or threaded rod which can be fitted at one end with a flat contact under which the pad layer is placed. The spindle can be fitted at the other end with a device for applying specified loads to the contact area, such as but not limited to a balance pan which accepts calibrated weights. The Indicator displays the displacement of the pad layer resulting from applying the load. The Indicater display is typically representative of inches or millimeters. The Electronic Indicator can be mounted on a stand, such as a Mitutoyo Precision Granite Stand, to provide stability while taking the measurements. The lateral dimensions of the pad layer can be sufficient to permit measurements at least 0.5" from any edge. The surface of the pad layer can be flat and parallel over a sufficient area to permit uniform contact between the test pad layer and the flat contact. The pad layer to be tested can be placed under the flat contact. The thickness of the pad layer can be measured prior to applying the load. Calibrated balance weights can be added to the balance pan for a specific resultant load. The pad layer then can be compressed under the specified load. The Indicator can display the thickness/height of the pad layer under the specified load. The thickness of the pad layer prior to applying the load minus the thickness of the pad layer under the specified load can be used to determine the displacement of the pad layer. In a non-limiting embodiment, a load of 20 psi can be applied to the pad layer. Measurements can be made at a standardized temperature such as room temperature. In a non-limiting embodiment, measurements can be taken at a temperature of 22° C. +/−2° C.

In a non-limiting embodiment, the above-described method of measuring pad layer thickness can be applicable to a stacked pad assembly or layer(s) comprising the stacked pad assembly.

In a non-limiting embodiment, a procedure for measuring percent volume compressibility can include placing the contact on the granite base and adjusting the indicator to read zero. The contact can then be raised and the specimen placed on the granite stand under the contact with the edge of the contact at least 0.5" from any edge of the specimen. The contact can be lowered onto the specimen and the specimen thickness measurement can be taken after 5+/−1 seconds. Without moving the specimen or the contact, sufficient weight can be added to the pan to cause a force of 20 psi to be applied to the specimen by the contact. The reading for the specimen thickness under load measurement can be made after 15+/−1 seconds. The measurement procedure can be repeated, making five measurements at different positions on the specimen at least 0.25" apart using 20 psi of compressive force.

The sublayer can comprise a wide variety of materials known in the art. Suitable materials can include natural rubber, synthetic rubbers, thermoplastic elastomer, foam sheet and combinations thereof. The material of the sublayer can be foamed or blown to produce a porous structure. The porous structure can be open cell, closed cell, or combinations thereof. Non-limiting examples of synthetic rubbers can include neoprene rubber, silicone rubber, chloroprene rubber, ethylene-propylene rubber, butyl rubber, polybutadiene rubber, polyisoprene rubber, EPDM polymers, styrene-butadiene copolymers, copolymers of ethylene and ethyl vinyl acetate, neoprene/vinyl nitrile rubber, neoprene/EPDM/SBR rubber, and combinations thereof. Non-limiting examples of thermoplastic elastomers can include polyolefins, polyesters, polyamides, polyurethanes such as those based on polyethers and polyesters, and copolymers thereof. Non-limiting examples of foam sheet can include ethylene vinyl acetate sheets and polyethylene foam sheets, such as but not limited to those which are commercially available from Sentinel Products, Hyannis, N.J.; polyurethane foam sheets, such as but not limited to those which are commercially available from Illbruck, Inc., Minneapolis, Minn.; and polyurethane foam sheets, and polyolefin foam sheets, such as but not limited to those which are available from Rogers Corporation, Woodstock, Conn.

In a further non-limiting embodiment, the sublayer can include non-woven or woven fiber mat, and combinations thereof; such as but not limited to polyolefin, polyester, polyamide, or acrylic fibers, which have been impregnated with a resin. The fibers can be staple or substantially continuous in the fiber mat. Non-limiting examples can include but are not limited to non-woven fabric impregnated with polyurethane as describe in U.S. Pat. No. 4,728,552, such as polyurethane impregnated felt. A non-limiting example of a commercially available non-woven subpad can be Suba™ IV, from Rodel, Inc. Newark Del.

The thickness of the sublayer can vary widely. In general, the sublayer thickness can be such that the pad can be placed on and taken off of the planarizing equipment with ease. If the pad is too thick, it can be difficult to place on and take off of the planarizing equipment. In alternate non-limiting embodiments, the sublayer can be at least 0.020 inches thick, or at least 0.04 inches thick, or at least 0.045 inches thick; or 0.100 or less inches thick, or 0.080 inches thick, or 0.065 inches thick.

The polishing pad of the present invention can comprise a middle layer. The middle layer can be selected from a variety of suitable materials known in the art. In a non-limiting embodiment, the middle layer can be substantially non-volume compressible. As used herein, the term "substantially non-volume compressible" means that the volume can be reduced by less than 1% when a load of 20 psi is applied. In alternate non-limiting embodiments, the percent volume compressibility of the middle layer can be at least one (1) percent; or three (3) percent or less, or from one (1) percent to three (3) percent. Tht percent volume compressibility can be determined using a variety of conventional methods known in the art. In a non-limiting embodiment, the method for applying the load and measuring the reduction in volume is described herein can be employed.

In a non-limiting embodiment, the flexibility of the middle layer can be such that the top layer can adequately conform to the macroscopic or long-term surface of the substrate being polished. The flexibility of the middle layer can vary widely. In a further non-limiting embodiment, the middle layer can be more flexible than the top layer. The flexibility of the middle layer can be determined using various methods known to the skilled artisan. In a non-limiting embodiment, "flexibility" (F) can be determined by the inverse relationship of middle layer thickness cubed ($t^3$) and the flexural modulus of the middle layer material (E), i.e. $F=1/t^3E$. In alternate non-limiting embodiments, the flexibility of the middle layer can be at least 1 $in^{-1}lb^{-1}$, or at least 100 $in^{-1}lb^{-1}$.

In another non-limiting embodiment, the middle layer can function to distribute the compressive forces experienced by the top layer over a larger area of the sublayer.

The middle layer can include a wide variety of materials known in the art. Suitable materials for the middle layer can comprise a wide variety of substantially non-compressible polymers, and metallic films and foils. Non-limiting examples of such polymers can include polyolefins, such as but not limited to low density polyethylene, high density polyethylene, ultra-high molecular weight polyethylene and polypropylene; polyvinylchloride; cellulose-based polymers, such as but not limited to cellulose acetate and cellulose butyrate; acrylic; polyesters and co-polyesters, such as but not limited to PET and PETG; polycarbonate; polyamide, such as nylon 6/6 and nylon 6/12; and high performance plastics, such as polyetheretherketone, polyphenylene oxide, polysulfone, polyimide, and polyetherimide. Non-limiting examples of metallic films can include aluminum, copper, brass, nickel and stainless steel.

The thickness of the middle layer can vary widely. In alternate non-limiting embodiments, the middle layer can have a thickness of at least 0.0005 inches, or 0.0030 inches or less; or from 0.0010 to 0.0020 inches.

In a non-limiting embodiment, the middle layer can function as a substantial barrier to fluid transport between the top layer and the sublayer. A consideration in selecting the material comprising the middle layer can be the ability of the material to substantially reduce, minimize or essentially prevent the transport of polishing slurry from the top layer to the sublayer. In a non-limiting embodiment, the middle layer can be essentially impermeable to polishing slurry such that the sublayer does not become substantially saturated with polishing slurry.

In an alternate non-limiting embodiment, the middle layer can be perforated such that polishing slurry can penetrate the top and middle layers to wet the sublayer. In a further non-limiting embodiment, the sublayer can be substantially saturated with polishing slurry. The perforations in the middle layer can be formed by a wide variety of suitable techniques known to the skilled artisan, such as punching, die cutting, laser cutting or water jet cutting. The hole size, number and configuration of the perforations can vary widely. In a non-limiting embodiment, the perforation hole diameter can be at least 1/16 inch, the number of holes can be at least 26 holes per square inch, in a staggered hole pattern.

The polishing pad of the present invention can comprise a top layer or polishing layer. The top layer can be selected from a variety of suitable materials known in the art. Non-limiting examples of suitable materials for the top layer can include but are not limited to particulate polymer and crosslinked polymer binder such as described in U.S. Pat. No. 6,477,926B1; particulate polymer and an organic polymer binder such as described in U.S. patent application Ser. No. 10/317,982; sintered particles of thermoplastic resin as described in U.S. Pat. Nos. 6,062,968; 6,117,000; and 6,126,532 describe; and pressure sintered powder compacts of thermoplastic polymer as described in U.S. Pat. Nos. 6,231,434 B1, 6,325,703 B2, 6,106,754 and 6,017,265. Further non-limiting examples of suitable materials for the top layer can include polymeric matrices impregnated with a plurality of polymeric microelements, wherein each polymeric microelement can have a void space within, as described in U.S. Pat. Nos. 5,900,164 and 5,578,362.

The thickness of the top layer can vary. In alternate non-limiting embodiments, the top layer can have a thickness of at least 0.020 inches, or at least 0.040 inches; or 0.150 inches or less, or 0.080 inches or less.

In another non-limiting embodiment, the top layer can include pores such that polishing slurry can be at least partially absorbed by the top layer. The number of pores can vary widely. In alternate non-limiting embodiments, the top layer can have a porosity, expressed as percent pore volume, of at least 2 percent by volume based on the total volume of the top layer, or 50 percent or less by volume based on the total volume of the top layer, or from 2 to 50 percent by volume based on the total volume of the top layer.

The percent pore volume of the polishing pad layer can be determined using a variety of techniques known in the art. In a non-limiting embodiment, the following expression can be used to calculate percent pore volume:

$$100\times(\text{density of the pad layer})\times(\text{pore volume of the pad layer}).$$

The density can be expressed in units of grams per cubic centimeter, and can be determined by a variety of conventional methods known in the art. In a non-limiting embodiment, the density can be determined in accordance with ASTM D 1622-88. The pore volume can be expressed in units of cubic centimeters per gram, and can be determined using conventional methods and equipment known in the art. In a non-limiting embodiment, pore volume can be measured in accordance with the mercury porosimetry method in ASTM D 4284-88, using an Autopore III mercury porosimeter from Micromeritics can be used. In a further non-limiting embodiment, the pore volume measurements can be made under the following conditions: a contact angle of 140°; a mercury surface tension of 480 dynes/cm; and degassing of the polishing pad layer sample under a vacuum of 50 micrometers of mercury.

In a non-limiting embodiment, the top layer can have at least a partially open cell structure such that it can absorb slurry. In alternate non-limiting embodiments, the top layer can absorb at least 2 percent by weight of polishing slurry based on the total weight of the top layer, or not more than 50 percent by weight, or from 2 percent by weight to 50 percent by weight.

In another non-limiting embodiment, the top layer can comprise grooves or patterns in the polishing surface. The types of grooves and/or patterns can vary and can include those types known in the art. The method of making the grooves and/or patterns can also vary and can include those conventional methods known in the art. In a non-limiting embodiment, the grooves can include concentric circles.

In a non-limiting embodiment, the sub-, middle and top layers can be at least partially aligned to form a stacked pad assembly. In a further non-limiting embodiment, the top layer of the polishing pad can be at least partially connected to at least a portion of a middle layer and the middle layer can be at least partially connected to at least a portion of the sublayer. The means for at least partially connecting the layers can vary widely. The layers can be at least partially connected using a variety of suitable means known to a skilled artisan. In a further non-limiting embodiment, the means for at least partially connecting the layers can include an adhesive material.

Suitable adhesive materials for use in the present invention can be selected from a wide variety known in the art. A suitable adhesive can provide sufficient peel resistance such that the pad layers essentially remain in place during use. Further, the adhesive can be selected to sufficiently withstand shear stresses which are present during the polishing or planarization process. Moreover, a suitable adhesive can be capable of sufficiently resisting chemical and moisture degradation during use. Non-limiting examples of suitable adhesive materials can include but are not limited to contact adhesives, pressure sensitive adhesives, structural adhesives, hot melt adhesives, thermoplastic adhesives, curable adhesives such as but not limited to thermosetting adhesives, and combinations thereof.

Non-limiting examples of pressure sensitive adhesives can include an elastomeric polymer and a tackifying resin. Non-limiting examples of elastomeric polymers can include natural rubber, butyl rubber, chlorinated rubber, polyisobutylene, poly(vinyl alkyl ethers), alkyd adhesives, acrylics such as but not limited to those based on copolymers of 2-ethylhexyl acrylate and acrylic acid, block copolymers such as but not limited to styrene-butadiene-styrene, and mixtures thereof. In alternate non-limiting embodiments, a pressure sensitive adhesive can be applied to a substrate using an organic solvent such as toluene or hexane, or from a water-based emulsion or from a melt.

Non-limiting examples of structural adhesives can include polyurethane adhesives and epoxy resin adhesives such as but not limited to those based on the diglycidyl ether of bisphenol A.

As used herein and the claims, the term "hot melt adhesive" refers to an adhesive comprised of a nonvolatile thermoplastic material that can be heated to a melt, then applied to a substrate as a liquid. Non-limiting examples of hot melt adhesives can include ethylene-vinyl acetate copolymers, styrene-butadiene copolymers, ethylene-ethyl acrylate copolymers, polyesters, polyamides such as but not limited to those formed from the reaction of diamine and dimer acid, and polyurethanes.

In a non-limiting embodiment, the middle layer can include an adhesive assembly. The adhesive assembly can include a middle layer interposed between an upper adhesive layer and a lower adhesive layer. In a non-limiting embodiment, the upper adhesive layer can be at least partially connected to the lower surface of the top layer, and the lower adhesive layer can be at least partially connected to the upper surface of the sublayer. The upper, middle, and lower layers of the adhesive assembly can be selected from the aforementioned suitable materials for the middle layer of the polishing pad. In a non-limiting embodiment, the upper and lower adhesive layers each can be contact adhesives. The adhesive assembly can be referred to in the art as two-sided or double-coated tape. Non-limiting examples of commercially available adhesive assemblies include those from 3M, Industrial Tape and Specialties Division under the trade names High-Strength Double Coated Tapes 9690 and 9609, Double Coated Film Tapes 442 and 443, High Performance Double Coated Tape 9500PC and Double Coated Polyester Tape 9490LE.

The polishing pad of the present invention can be used in combination with various polishing slurries known in the art. Non-limiting examples of suitable slurries for use with the pad of the present invention, include but are not limited to the slurries disclosed in U.S. patent application having Ser. Nos. 09/882,548 and 09/882, 549, which were both filed on Jun. 14, 2001 and are pending. In a non-limiting embodiment, the polishing slurry can be interposed between the top layer of the pad and the substrate to be polished. The polishing or planarizing process can include moving the polishing pad relative to the substrate being polished. A variety of polishing slurrys or slurries are known in the art. Non-limiting examples of suitable slurries for use in the present invention include slurries comprising abrasive particles. Abrasives that can be used in the slurries include particulate cerium oxide, particulate alumina, particulate silica and the like. Examples of commercial slurries for use in the polishing of semiconductor substrates include but are not limited to ILD1200 and ILD1300 available from Rodel, Inc. Newark Del. and Semi-Sperse AM100 and Semi-Sperse 12 available from Cabot Microelectronics Materials Division, Aurora, Ill.

In a non-limiting embodiment, the polishing pad of the present invention can be utilized with an apparatus for planarizing an article having a non-planar surface. The planarizing apparatus can include a retaining means for holding the article; and a motive power means for moving the pad and the retaining means with respect to the other such that movement of the pad and the retaining means causes the slurry and the planarizing surface of the pad to contact and planarize the non-planar surface of the article. In a further non-limiting embodiment, the planarizing apparatus can include a means of renewing the polishing or planarizing surface of the pad, such as but not limited to a mechanical arm equipped with an abrasive disk which abrades the work surface of the pad.

The present invention is more particularly described in the following examples, which are intended to be illustrative only, since numerous modifications and variations therein will be apparent to those skilled in the art. Unless otherwise specified, all parts and all percentages are by weight.

EXAMPLES

Example A

Particulate crosslinked polyurethane was prepared from the ingredients listed in Table A. The particulate crosslinked polyurethane was used to prepare polishing layers as described further herein in Example 1.

TABLE A

| Ingredients | Weight (grams) |
|---|---|
| Charge 1 | |
| diamine curative (a) | 810 |
| surfactant (b) | 30.6 |
| methyl isobutyl ketone solvent | 822 |
| Charge 2 | |
| isocyanate functional prepolymer (c) | 2112 |

(a) LONZACURE MCDEA diamine curative obtained from Air Products and Chemicals, Inc, which describes it as methylene bis (chlorodiethylanaline).
(b) PLURONIC F108 surfactant, obtained from BASF Corporation.
(c) AIRTHANE PHP-75D prepolymer, obtained from Air Products and Chemicals, Inc, which describes it as the isocyanate functional reaction product of toluene diisocyanate and poly(tetramethylene glycol).

Charge 1 was added to an open container and warmed with stirring on a hot plate until the contents of the container reached a temperature of 35° C. Stirring was continued at this temperature until the ingredients formed a substantially homogeneous solution. The container was then removed from the hot plate. Charge 2 was warmed to a temperature of 55° C. using a water bath. Charge 2 was then added to Charge 1; the contents were mixed for 3 minutes with a motor driven impeller until substantially uniform. The contents of the container were then quickly poured into kilograms of deionized water at a temperature of 40° C., with concurrent vigorous stirring of the deionized water. Upon completion of the addition of the contents of the container, vigorous mixing was continued for an additional 60 minutes. The wet particulate crosslinked polyurethane was classified using a stack of two sieves. The sieve on the top had a mesh size of 50 mesh (300 micron sieve openings) and the sieve on the bottom had a mesh size of 140 mesh (105 micron sieve openings). The isolated particulate crosslinked polyurethane from the 140 mesh was dried overnight in an oven at a temperature of 80° C.

Example 1

Preparation of Polishing Layer

A polishing layer (top layer) comprising particulate crosslinked polyurethane and crosslinked polyurethane binder was prepared from the ingredients summarized in the following Table 1.

TABLE 1

| Ingredients | Weight (grams) |
|---|---|
| Charge 1 | |
| particulate crosslinked polyurethane of Example A | 918 |
| Charge 2 | |
| isocyanate functional prepolymer (c) | 265 |
| aliphatic polyisocyanate (d) | 8.5 |
| additive (e) | 8.5 |
| acetone solvent | 62 |

(d) DESMODUR N 3300 aliphatic polyisocyanate, obtained from Bayer Corporation, Coatings and Colorants Division, which describes it as a polyfunctional aliphatic isocyanate resin based on hexamethylene diisocyanate.
(e) Lanco PP1362D micronized modified polypropylene wax, obtained from The Lubrizol Corporation.

Charge 2 was mixed using a motor driven stainless steel impeller until substantially homogenous. The substantially homogenous mixture of Charge 2 was then combined with Charge 1 in a suitable container and mixed together by means of a motor driven mixer. A 1040 gram portion of the combination of Charges 1 and 2 was then introduced onto a 26"×26" flat mold. The mold was fed through a pair of rollers at ambient temperature to form a sheet that was 0.100" thick. The sheet was cured at a temperature of 25° C. and 80% relative humidity, for 18 hours; followed by a temperature of 130° C. for 1 hour. Circular pads having a 22.5" diameter were cut from the sheet using a press with cutting die. The upper and lower surfaces of the pad were made parallel using a milling machine.

Example 2

Three-Layer Polishing Pad Assembly

The polishing layer of Example 1 was fabricated into a three-layer polishing pad assembly. The polishing layer was at least partially connected to a second (i.e., middle) layer. The middle layer consisted of a sheet of double-coated polyester film tape and release liner, commercially obtained from 3M under product number 9609. The adhesive side was applied to the polishing layer such that it essentially covered the lower surface of the polishing layer. The release liner on the other side of the middle layer was then removed to expose the adhesive, and a top layer was applied to the exposed adhesive layer. The top layer consisted of a polyurethane foam disk having a diameter of 22.5", a thickness of 1/16" and a density of 0.48 g/cm$^3$. Another double-coated film tape with release liner was commercially obtained from 3M under product number 442. The adhesive side was applied to the exposed surface of the polyurethane foam. The remaining release liner on the other side can be removed to permit attachment to a commercial planarizing apparatus. Physical properties of the individual layers are summarized in Table 2.

TABLE 2

| Layer | Compressibility (@ 20 psi) | Shore A Hardness | Flexibility | Pore volume |
|---|---|---|---|---|
| Sub | 2.6% | 66 | n/a | n/a |
| Second | 0.0% | n/a | 312 $in^{-1}$ $lb^{-1}$ | n/a |
| Polishing | 1.7% | 99 | n/a | 18% |

Example B

Particulate crosslinked polyurethane was prepared from the ingredients listed in Table B. The particulate crosslinked polyurethane was used to prepare polishing layers as described further herein in Example 3.

TABLE B

| Ingredients | Weight (grams) |
|---|---|
| Charge 1 | |
| diamine curative (a) | 1050 |
| surfactant (b) | 31.5 |
| methyl isobutyl ketone solvent | 860 |
| Charge 2 | |
| isocyanate functional prepolymer (c) | 1570 |
| aliphatic polyisocyanate (d) | 446 |

Charge 1 was added to an open container and warmed with stirring on a hot plate until the contents of the container reached a temperature of 35° C. Stirring was continued at this temperature until the ingredients formed a substantially homogeneous solution. The container was then removed from the hot plate. With stirring, Charge 2 was warmed to a temperature of 55° C. using a water bath. Charge 2 was then added to Charge 1. The contents were mixed for 2 minutes with a motor driven impeller until substantially uniform. The contents of the container were then quickly poured into 10 kilograms of deionized water at a temperature of 30° C., with concurrent vigorous stirring. Upon completion of the addition of the contents of the container, vigorous mixing was continued for an additional minutes. The wet particulate crosslinked polyurethane was classified using a stack of two sieves. The sieve on the top had a mesh size of 50 mesh (300 micron sieve openings) and the sieve on the bottom had a mesh size of 140 mesh (105 micron sieve openings). The isolated particulate crosslinked polyurethane particulate from the 140 mesh was dried overnight in an oven at a temperature of 80° C.

Example 3

Polishing Layer Preparation

A polishing layer (top layer) comprising particulate crosslinked polyurethane and crosslinked polyurethane binder was prepared from the ingredients summarized in the following Table 3.

TABLE 3

| Ingredients | Weight (grams) |
|---|---|
| Charge 1 | |
| particulate crosslinked polyurethane of Example B | 2337 |

TABLE 3-continued

| Ingredients | Weight (grams) |
|---|---|
| Charge 2 | |
| isocyanate functional prepolymer (c) | 410.4 |
| aliphatic polyisocyanate (d) | 102.6 |
| catalyst (f) | 0.25 |
| acetone solvent | 120 |

(f) dibutyltin dilaurate 95%, obtained from Sigma-Aldrich Corporation.

Charge 2 was mixed with a motor driven stainless steel impeller until substantially homogenous. The substantially homogenous mixture of Charge 2 was then combined with Charge 1 in a suitable container and mixed together by means of a motor driven mixer until substantially uniform. A 930-gram portion of the combination of Charges 1 and 2 was introduced onto each of three 26"×26" flat molds. The molds were fed through a pair of rollers at ambient temperature to form three sheets that were 0.100" thick. The sheets were cured at a temperature of 25° C. and 80% relative humidity for 18 hours, followed by a temperature of 130° C. for 1 hour. Circular pads having a 22.5" diameter were cut from the sheets using a press with cutting die. The upper and lower surfaces of the pad were made parallel using a milling machine.

Example 4

Three-Layer Polishing Pad

The polishing layer of Example 3 was fabricated into a three-layer polishing pad assembly. The polishing layer was at least partially connected to a second (i.e., middle) layer. The middle layer consisted of a sheet of double-coated polyester film tape and release liner, commercially obtained from 3M under product number 9609. The adhesive side was applied to the polishing layer such that it essentially covered the lower surface of the polishing layer. The release liner on the other side of the middle layer was then removed to expose the adhesive, and a top layer was applied to the exposed adhesive layer. The top layer consisted of a 22.5" diameter SUBA IV pad. Physical properties of the individual layers are summarized in Table 4.

TABLE 4

| Layer | Compressibility (@ 20 psi) | Shore A Hardness | Flexibility | Pore Volume |
|---|---|---|---|---|
| Sub | 4.6% | 72 | n/a | n/a |
| Second | 0.0% | n/a | 312 $in^{-1}$ $lb^{-1}$ | n/a |
| Polishing | 0.6–% | 99 | n/a | 17% |

Example 5

Three Layer Polishing Pad

The polishing layer of Example 3 was fabricated into a three-layer polishing pad assembly. The polishing layer was at least partially connected to a second (i.e., middle) layer. The middle layer consisted of a sheet of double-coated polyester film tape and release liner, commercially obtained from 3M under product number 9609. The adhesive side was applied to the polishing layer such that it essentially covered the lower surface of the polishing layer. The release liner on the other side of the middle layer was then removed to expose the adhesive, and a top layer was applied to the exposed adhesive layer. The top layer consisted of a polyurethane foam disk having a diameter of 22.5", a thickness of 1/16" and a density of 0.32 g/cm$^3$. Another double-coated film tape with release liner was commercially obtained from 3M under product number 442. The adhesive side was applied to the exposed surface of the polyurethane foam. The remaining release liner on the other side can be removed to permit attachment to a commercial planarizing apparatus. Physical properties of the individual layers are summarized in Table 5.

TABLE 5

| Layer | Compressibility (@ 20 psi) | Shore A Hardness | Flexibility | Pore volume |
|---|---|---|---|---|
| Sub | 15.3% | 26 | n/a | n/a |
| Second | 0.0% | n/a | 312 in$^{-1}$ lb$^{-1}$ | n/a |
| Polishing | 0.6% | 99 | n/a | 17% |

Examples 6–9

Polishing pads comprising particulate crosslinked polyurethane and crosslinked polyurethane binder were prepared from the ingredients summarized in the following Table 6. Physical data of the polishing pads of Examples 6–9 are summarized in Table 7.

TABLE 6

| Ingredients | Weight (grams) Examples 6 | 7 | 8 | 9 |
|---|---|---|---|---|
| Charge 1 | | | | |
| particulate crosslinked polyurethane of Example A | 5.72 | 5.39 | 5.06 | 6.51 |
| isocyanate functional prepolymer (dd) | 1.35 | 1.69 | 2.04 | 3.32 |
| acetone solvent | 1.1 | 1.1 | 1.1 | 1.2 |
| Charge 2 | | | | |
| particulate crosslinked polyurethane of Example A | 2.20 | 2.10 | 2.00 | 2.52 |
| diamine curative (aa) | 0.45 | 0.56 | 0.68 | 1.11 |
| diamine curative (bb) | 0.18 | 0.22 | 0.26 | 0.43 |
| acetone solvent | 1.1 | 1.1 | 1.1 | 1.2 |

(aa) LONZACURE MCDEA diamine curative obtained from Air Products and Chemicals, Inc, which describes it as methylene bis (chlorodiethylanaline).
(bb) VERSALINK P-650 poly(tetramethylene glycol) diamine curative obtained from Air Products and Chemicals, Inc.
(dd) ARITHANE PHP-75D prepolymer, obtained from Air Products and Chemicals, Inc, which describes it as the isocyanate functional reaction product of toluene diisocyanate and poly(tetramethylene glycol).

Charges 1 and 2 were each separately mixed by hand using a stainless steel spatula until substantially homogenous. The substantially homogenous mixtures of Charges 1 and 2 were then combined in a suitable container and mixed together by means of a motor driven impeller. A portion of the combination of Charges 1 and 2 was then introduced into a 1.6 millimeter deep open circular mold having a diameter of 8.3 centimeters. The mold was closed and the contents were leveled by pressing. The filled mold was placed in an oven at a temperature of 120° C. for minutes. The mold was then removed from the oven and allowed to cool to ambient room temperature (about 25° C.), followed by demolding of the polishing pad from the mold. The pad was then returned to the oven at a temperature of 120° C. for an additional hour to complete the cure.

TABLE 7

| Polishing Pad Physical Properties | Example 6 | Example 7 | Example 8 | Example 9 |
|---|---|---|---|---|
| Percent Pore Volume (n) | 21.5 | 17.6 | 7.0 | 2.0 |
| Average Pore Diameter (microns) (q) | 32 | 22 | 27 | 56 |
| Percent Slurry Absorption (r) | 21.1 | 7.6 | 3.7 | 2.2 |

(n) Percent pore volume was calculated from the following equation: 100 × (density) × (pore volume).
(q) Analysis conducted for pores having apparent diameters in the range of 8–150 microns.
(r) Percent slurry absorption was determined using the following method: 1 inch × 3 inch specimens of pad material were cut and pre-weighed to the nearest 0.001 gram. The specimens were then immersed in a container of CMP slurry (i.e., ILD 1300, Rodel, Inc., Newark, DE) maintained at a temperature of 23+/−1° C. for 24 hours. At the end of 24 hours the specimens were removed from the slurry, excess slurry removed from the surface, and wet specimens immediately weighed to the nearest 0.001 gram. The percent slurry absorption was calculated as follows:

$$\text{Slurry absorption, \%} = \frac{\text{wet weight} - \text{dry weight}}{\text{dry weight}} \times 100$$

The present invention has been described with reference to specific details of particular embodiments thereof. It is not intended that such details be regarded as limitations upon the scope of the invention except insofar as and to the extent that they are included in the accompanying claims.

What is claimed is:

1. A polishing pad comprising:

a. asublayer, b. a middle layer; and c. a top layer, wherein said top layer is at least partially connected to said middle layer and said middle layer is at least partially connected to said sublayer, and wherein said top layer absorbs at least two percent by weight of polishing slurry based on total weight of said top layer.

2. The polishing pad of claim 1 wherein said top layer absorbs 50% or less by weight of polishing slurry based on total weight of said top layer.

3. The polishing pad of claim 1 wherein said top layer is selected from particulate polymer and crosslinked polymer binder; particulate polymer and an organic polymer binder; sintered particles of thermoplastic resin; pressure sintered powder compacts of thermoplastic polymer; polymeric matrices impregnated with a plurality ofpolyineric microelements wherein each polymeric microelement can have a void space therein, or combinations thereof.

4. The polishing pad of claim 1 wherein said top layer has a thickness of at least 0.020 inches.

5. The polishing pad of claim 4 wherein said top layer has a thickness of 0.150 inches or less.

6. The polishing pad of claim 1 wherein said top layer further comprises grooves in a polishing surface.

7. The polishing pad of claim 1 wherein said top layer further comprises a pattern in a polishing surface.

8. The polishing pad of claim 1 wherein said middle layer is selected from substantially non-volume compressible polymers and metallic films and foils.

9. The polishing pad of claim 1 wherein said middle layer is selected from polyolefins; cellulose-based polymers; acrylics; polyesters and co-polyesters; polycarbonate; polyamides; high performance plastics; or mixtures thereof.

10. The polishing pad of claim 1 wherein said middle layer is selected from low density polyethylene, high density polyethylene ultra-high molecular weight polyethylene or polypropylene; cellulose acetate or cellulose butyrate; PET or PETG; nylon 6/6 or nylon 6/12; polyotheretherketone, polyphenylene oxide, polysulfone, polyimide, or polyetherimide; or mixtures thereof.

11. The polishing pad of claim 1 wherein said middle layer has a thickness of at least 0.0005 inches.

12. The polishing pad of claim 11 wherein said middle layer has a thickness of 0.0030 inches or less.

13. The polishing pad of claim 1 wherein said sublayer is selected from natural rubber, synthetic rubbers, thermoplastic elastomer, foam sheet and combinations thereof.

14. The polishing pad of claim 1 wherein said sublayer has a thickness of at least 0.020 inches.

15. The polishing pad of claim 14 wherein said sublayer has a thickness of 0.100 inches or less.

16. The polishing pad of claim 1 wherein said sublayer, middle layer and top layer are at least partially connected by an adhesive material.

17. The polishing pad of claim 16 wherein said adhesive material is selected from contact adhesives, pressure sensitive adhesives, structural adhesives, hot melt adhesives, thermoplastic adhesives, and curable adhesives, thermosetting adhesives; and combinations thereof.

18. The polishing pad of claim 1 wherein said sublayer has a percent volume compressibility that is greater than the top layer.

19. The polishing pad of claim 18 wherein said percent volume compressibility of said sublayer is less than 20% when a load of 20 psi is applied.

20. The polishing pad of claim 18 wherein said percent volume compressibility of the top layer is 3% or less when a load of 20 psi is applied.

21. The polishing pad of claim 1 wherein said middle layer is substantially non-volume compressible.

22. The polishing pad of claim 1 wherein said middle layer has a flexibility of at least 1 $in^{-1}$ $lb^{-1}$ .

23. The polishing pad of claim 1 wherein said middle layer comprises an adhesive assembly.

24. A polishing pad comprising:

a. a sublayer;

b. a middle layer; and c. a top layer, wherein said top layer is at least partially connected to said middle layer and said middle layer is at least partially connected to said sublayer, and wherein said top layer has a porosity of at least two percent by volume based on total volume of said top layer.

25. The polishing pad of claim 24 wherein said top layer has a porosity of 50% or less by volume based on total volume of said top layer.

26. The polishing pad of claim 24 wherein said top layer is selected from particulate polymer and crosslinked polymer binder; particulate polymer and an organic polymer binder; sintered particles of thermoplastic resin; pressure sintered powder compacts of thermoplastic polymer, polymeric matrices impregnated with a plurality of polymeric microelements wherein each polymeric microelement can have a void space therein, or combinations thereof.

27. The polishing pad of claim 24 wherein said top layer has a thickness of at least 0.020 inches.

28. The polishing pad of claim 27 wherein said top layer has a thickness of 0.150 inches or less.

29. The polishing pad of claim 24 wherein said top layer further comprises grooves in a polishing surface.

30. The polishing pad of claim 24 wherein said top layer further comprises a pattern in a polishing surface.

31. The polishing pad of claim 24 wherein said middle layer is selected from substantially non-volume compressible polymers and metallic films and foils.

32. The polishing pad of claim 24 wherein said middle layer is selected from polyolefins; cellulose-based polymers; acrylics; polyesters and co-polyesters; polycarbonate; polyamides; high performance plastics; or mixtures thereof.

33. The polishing pad of claim 1 wherein said middle layer is selected from low density polyethylene, high density polyethylene ultra-high molecular weight polyethylene or polypropylene; cellulose acetate or cellulose butyrate; PET or PETG; nylon 6/6 or nylon 6/12; polyetheretherketone, polyphenylene oxide, polysulfone, polyimide, or polyetherimide; or mixtures thereof.

34. The polishing pad of claim 24 wherein said middle layer has a thickness of at least 0.0005 inches.

35. The polishing pad of claim 34 wherein said middle layer has a thickness of 0.0030 inches or less.

36. The polishing pad of claim 24 wherein said sublayer is selected from natural rubber, synthetic rubbers, thermoplastic elastomer, foam sheet and combinations thereof.

37. The polishing pad of claim 24 wherein said sublayer has a thickness of at least 0.020 inches.

38. The polishing pad of claim 37 wherein said sublayer has a thickness of 0.100 inches or less.

39. The polishing pad of claim 34 wherein said sublayer, middle layer and top layer are at least partially connected by an adhesive material.

40. The polishing pad of claim 39 wherein said adhesive material is selected from contact adhesives, pressure sensitive adhesives, structural adhesives, hot melt adhesives, thermoplastic adhesives, curable adhesives, thermosetting adhesives and combinations thereof.

41. A polishing pad comprising:

a. a sublayer, b. a middle layer; and c. a top layer, wherein said sublayer is at least partially connected to said middle layer and said middle layer is at least partially connected to said top layer, and wherein said top layer has a percent volume compressibility greater than said middle layer.

42. The polishing pad of claim 41 wherein said top layer has a percent volume compressibility of at least 0.3% when a load of 20 psi is applied.

43. The polishing pad of claim 42 wherein said top layer has a percent volume compressibility of 3% or less when a load of 20 psi is applied.

44. The polishing pad of claim 41 wherein said middle layer is substantially non-volume compressible.

45. The polishing pad of claim 41 wherein said middle layer has a percent volume compressibility of at least 1 percent when a load of 20 psi is applied.

46. The polishing pad of claim 41 wherein said middle layer has a percent volume compressibility of 3 percent or less when a load of 20 psi is applied.

47. The polishing pad of claim 41 wherein said top layer is selected from particulate polymer and crosslinked polymer binder; particulate polymer and an organic polymer binder; sintered particles of thermoplastic resin; pressure sintered powder compacts of thermoplastic polymer, polymeric matrices impregnated with a plurality of polymeric microelements wherein each polymeric microelement can have a void space therein, or combinations thereof.

48. The polishing pad of claim 41 wherein said top layer has a thickness of at least 0.020 inches.

49. The polishing pad of claim 48 wherein said top layer has a thickness of 0.150 inches or less.

50. The polishing pad of claim 41 wherein said top layer further comprises grooves in a polishing surface.

51. The polishing pad of claim 41 wherein said top layer further comprises a pattern in a polishing surface.

52. The polishing pad of claim 41 wherein said middle layer is selected from substantially non-volume compressible polymers and metallic films and foils.

53. The polishing pad of claim 41 wherein said middle layer is selected from polyolefins; cellulose-based polymers; acrylics; polyesters and co-polyesters; polycarbonate; polyamides; high performance plastics; or mixtures thereof.

54. The polishing pad of claim 41 wherein said middle layer is selected from low density polyethylene, high density polyethylene ultra-high molecular weight polyethylene or polypropylene; cellulose acetate or cellulose butyrate; PET or PETG; nylon 6/6 or nylon 6/12; polyetheretherketone, polyphenylene oxide, polysulfone, polyimide, or polyetherimide; or mixtures thereof.

55. The polishing pad of claim 41 wherein said middle layer comprises an adhesive assembly.

56. The polishing pad of claim 41 wherein said middle layer has a thickness of at least 0.0005 inches.

57. The polishing pad of claim 56 wherein said middle layer has a thickness of 0.0030 inches or less.

58. The polishing pad of claim 41 wherein said sublayer is selected from natural rubber, synthetic rubbers, thermoplastic elastomer, foam sheet and combinations thereof.

59. The polishing pad of claim 41 wherein said sublayer has a thickness of at least 0.020 inches.

60. The polishing pad of claim 59 wherein said sublayer has a thickness of 0.100 inches or less.

61. The polishing pad of claim 41 wherein said sublayer, middle layer and top layer are at least partially connected by an adhesive material.

62. The polishing pad of claim 61 wherein said adhesive material is selected from contact adhesives, pressure sensitive adhesives, structural adhesives, hot melt adhesives, thermoplastic adhesives, curable adhesives, therniosetting adhesives and combinations thereof.

63. A polishing pad comprising:

a. a sublayer;

b. a middle layer; and c. a top layer, wherein said sublayer is at least partially connected to said middle layer and said middle layer is at least partially connected to said top layer, and wherein said sublayer is softer than said top layer.

64. A method of preparing a polishing pad comprising at least partially connecting a top layer to a middle layer; and at least partially connecting said middle layer to a sublayer, wherein said top layer absorbs at least two percent by weight of polishing slurry based on total weight of said top layer.

65. The method of claim 64 wherein said top, middle and sub layers are at least partially connected by an adhesive material.

66. A method of preparing a polishing pad comprising at least partially connecting a top layer to a middle layer; and at least partially connecting said middle layer to a sublayer, wherein said top layer has a porosity of at least two percent by volume based on total volume of said top layer.

67. The method of claim 66 wherein said top, middle and sub layers are at least partially connected by an adhesive material.

68. A method of preparing a polishing pad comprising at least partially connecting a top layer to a middle layer; and at least partially connecting said middle layer to a sublayer, wherein said wherein said top layer has a percent volume compressibility greater than said middle layer.

69. The method of claim 68 wherein said top, middle and sub layers are at least partially connected by an adhesive material.

* * * * *